US010035115B2

(12) United States Patent
Minard

(10) Patent No.: US 10,035,115 B2
(45) Date of Patent: Jul. 31, 2018

(54) RE-FILLABLE SYRUP BIN FOR BEVERAGE MACHINE

(71) Applicant: Carrier Corporation, Farmington, CT (US)

(72) Inventor: James J. Minard, Roscoe, IL (US)

(73) Assignee: Taylor Commercial Foodservice Inc., Rockton, IL (US)

( * ) Notice: Subject to any disclaimer, the term of this patent is extended or adjusted under 35 U.S.C. 154(b) by 365 days.

(21) Appl. No.: 14/864,273

(22) Filed: Sep. 24, 2015

(65) Prior Publication Data

US 2016/0089647 A1 Mar. 31, 2016

Related U.S. Application Data

(60) Provisional application No. 62/056,036, filed on Sep. 26, 2014.

(51) Int. Cl.
*B01F 13/10* (2006.01)
*B01F 15/02* (2006.01)

(52) U.S. Cl.
CPC ..... *B01F 13/1066* (2013.01); *B01F 15/02* (2013.01); *B01F 15/0201* (2013.01); *B01F 15/0202* (2013.01); *B01F 15/0203* (2013.01); *B01F 15/0205* (2013.01); *B01F 15/0234* (2013.01); *B01F 15/0235* (2013.01); *B01F 15/0222* (2013.01); *B01F 2215/0022* (2013.01)

(58) Field of Classification Search
CPC ..... B01F 13/1066; B01F 2215/0022; B01F 15/0205; B01F 15/02; B01F 15/0201; B01F 15/0203; B01F 15/0202; B01F 15/0234; B01F 15/0235; B01F 15/0222
See application file for complete search history.

(56) References Cited

U.S. PATENT DOCUMENTS 2,709,519 A * 5/1955 Cushman ..... B65B 1/28 206/497
2,772,817 A * 12/1956 Jauch ..... A47K 5/1209 222/207
3,116,747 A * 1/1964 Cowles ..... F16K 13/04 137/68.11
3,117,695 A * 1/1964 Cox, Jr. ..... B65D 75/5872 222/105
3,193,143 A * 7/1965 Maieli ..... B67D 3/0012 222/129.4
3,243,084 A * 3/1966 Stegner ..... B65D 83/00 222/105

(Continued)

*Primary Examiner* — Tony G Soohoo
(74) *Attorney, Agent, or Firm* — Brinks Gilson & Lione

(57) ABSTRACT

A beverage dispenser includes a mixing portion to mix a plurality of beverage ingredients and a dispensing portion to dispense the mixed beverage. The dispenser further includes a product input portion having a plurality of refillable ingredient bins operably connectible to the mixing portion. Each refillable ingredient bin includes a self-closing seal located at a bin outlet to prevent leakage of the beverage ingredients from the bin outlet when the refillable ingredient bin is disconnected from the mixing portion. An ingredient bin assembly for a beverage dispensing machine includes a refillable ingredient bin having a bin outlet and a self-closing seal positioned at the bin outlet to prevent leakage of beverage ingredients from the bin outlet when the refillable ingredient bin is disconnected from a beverage dispensing machine.

12 Claims, 6 Drawing Sheets

(56) References Cited

U.S. PATENT DOCUMENTS 3,297,206 A * 1/1967 Scholle ..... B65D 47/061 222/105
3,341,073 A * 9/1967 Arps ..... B67D 3/00 222/129.4
3,368,721 A * 2/1968 Wiskochil ..... B65D 25/40 206/509
3,371,824 A * 3/1968 Goss ..... B65D 77/06 222/105
3,435,990 A * 4/1969 Pike, Jr. ..... B67D 1/0001 222/1
3,595,467 A * 7/1971 Goglio ..... B65D 77/225 137/843
3,626,980 A * 12/1971 Svensson ..... A61F 5/441 137/614.2
3,811,294 A * 5/1974 Taylor ..... B67D 3/0009 222/146.1
3,837,533 A * 9/1974 Splan ..... B65D 35/14 222/105
3,920,149 A * 11/1975 Fortino ..... B67D 3/0006 222/1
3,940,018 A * 2/1976 Scholle ..... B65D 77/06 206/506
3,949,934 A * 4/1976 Goglio ..... B65D 77/225 383/103
3,964,636 A * 6/1976 Rehrig ..... B65D 77/06 206/509
4,124,146 A * 11/1978 Sealfon ..... G01F 13/00 222/641
4,314,768 A * 2/1982 Goglio ..... B65D 75/5877 222/105
4,316,557 A * 2/1982 Benoun ..... B67D 1/0004 222/129.1
4,378,078 A * 3/1983 Daniels ..... A47J 31/404 222/183
4,703,870 A * 11/1987 Sedam ..... B67D 1/0079 137/565.3
4,757,920 A * 7/1988 Harootian, Jr. ..... B67D 1/0869 220/4.22
4,773,561 A * 9/1988 Sedam ..... B67D 1/0079 220/373
4,796,788 A * 1/1989 Bond ..... B65D 77/067 222/105
4,890,772 A * 1/1990 Heuberger ..... B65D 5/42 222/156
4,898,308 A * 2/1990 Rudick ..... B65D 47/088 222/325
5,029,734 A * 7/1991 Nichols ..... B65D 19/06 108/55.3
5,064,096 A * 11/1991 Illing ..... B65D 77/061 222/105
5,086,950 A * 2/1992 Crossdale ..... B67D 3/0019 222/185.1
5,102,010 A * 4/1992 Osgar ..... B65D 47/36 222/1
5,133,482 A * 7/1992 Burrows ..... B67D 3/0003 222/185.1
5,163,587 A * 11/1992 Apps ..... B65D 21/0212 206/505
5,172,831 A * 12/1992 Burrows ..... B67D 1/0079 222/1
5,330,154 A * 7/1994 Mashburn ..... F16L 37/248 251/144
5,419,448 A * 5/1995 Watson ..... B65D 77/061 220/4.28
5,555,996 A * 9/1996 Lang-Ree ..... B65D 43/164 206/505
5,641,012 A * 6/1997 Silversides ..... A01C 15/006 137/846
5,673,823 A * 10/1997 Hanks ..... B65D 1/20 222/185.1
5,694,991 A * 12/1997 Harris ..... B67D 1/0835 137/614.03
5,890,616 A * 4/1999 Cravens ..... B65D 25/16 220/23.86
5,938,078 A * 8/1999 Dorsey ..... B67D 3/0009 222/105
5,967,322 A * 10/1999 Apps ..... B65D 21/064 206/497
6,003,733 A * 12/1999 Wheeler ..... B67D 1/0004 222/146.5
6,016,935 A * 1/2000 Huegerich ..... B67D 1/0007 222/146.1
6,050,444 A * 4/2000 Sugg ..... B65D 47/2018 215/229
6,050,455 A * 4/2000 Soehnlen ..... B65D 1/20 215/382
6,056,157 A * 5/2000 Gehl ..... B65D 77/06 222/105
6,378,730 B1 * 4/2002 Reddy ..... B67B 7/26 222/541.9
6,419,121 B1 * 7/2002 Gutierrez ..... B67D 1/0004 222/146.5
6,607,097 B2 * 8/2003 Savage ..... B65D 75/5877 220/62.12
6,644,510 B2 * 11/2003 Kawolics ..... B65D 47/2075 222/105
6,793,387 B1 * 9/2004 Neas ..... B01F 13/1058 141/104
6,871,015 B2 * 3/2005 Gutierrez ..... B67D 1/0004 222/146.1
6,938,801 B1 * 9/2005 Reddy ..... B67D 1/0007 222/132
6,971,550 B2 * 12/2005 Kuge ..... B65D 47/247 222/105
7,147,134 B2 * 12/2006 Gutierrez ..... B67D 1/0004 222/146.1
7,223,426 B2 * 5/2007 Cheng ..... A23F 5/243 222/137
7,282,176 B2 * 10/2007 Glachet ..... B01L 1/02 220/315
7,331,487 B2 * 2/2008 Macler, II ..... B67B 7/28 222/105
7,708,035 B2 * 5/2010 Windmiller ..... B65D 1/06 141/113
7,762,429 B2 * 7/2010 Macler ..... B67B 7/28 222/105
7,972,064 B2 * 7/2011 Anderson ..... B65D 33/2508 251/82
8,177,096 B2 * 5/2012 Macler ..... B67B 7/28 222/105
8,800,817 B2 * 8/2014 Norris ..... B67D 3/0009 222/131
9,045,260 B2 * 6/2015 Norris ..... B67D 3/0029
9,717,354 B2 * 8/2017 Gehl ..... A47G 19/183
9,739,272 B2 * 8/2017 Dobbins ..... F04B 43/1261
2006/0118581 A1 * 6/2006 Clark ..... B01F 13/1055 222/333
2006/0283879 A1 * 12/2006 Rasmussen ..... B67D 1/0001 222/81
2009/0158937 A1 * 6/2009 Stearns ..... A47J 31/41 99/280
2009/0178570 A1 * 7/2009 Minard ..... A47J 31/402 99/289 R
2010/0089921 A1 * 4/2010 Ellenkamp-Van Olst ..... B65D 47/0809 220/254.3
2012/0097705 A1 * 4/2012 Py ..... B67B 7/24 222/83
2012/0230148 A1 * 9/2012 Van Opstal ..... B01F 7/00216 366/167.1
2014/0154391 A1 * 6/2014 Mehta ..... A23L 2/54 426/590
2014/0263454 A1 * 9/2014 Connerat ..... B67D 1/0078 222/153.06

(56) References Cited

U.S. PATENT DOCUMENTS

| | | | | |
|---|---|---|---|---|
| 2015/0245734 | A1* | 9/2015 | Vogelsang | A47J 31/60<br>99/289 R |
| 2016/0089647 | A1* | 3/2016 | Minard | B01F 13/1066<br>366/177.1 |
| 2016/0096157 | A1* | 4/2016 | Mazarei | G05D 11/132<br>700/265 |

* cited by examiner

RE-FILLABLE SYRUP BIN FOR BEVERAGE MACHINE

CROSS REFERENCE TO RELATED APPLICATIONS

This application claims the benefit of an earlier filing date from U.S. Provisional Application Ser. No. 62/056,036 filed Sep. 26, 2014, the entire disclosure of which is incorporated herein by reference.

BACKGROUND

The subject matter disclosed herein relates to beverage machines. More specifically, the present disclosure relates to additive bins for beverage machines.

Syrups and other additives are utilized in beverage machines and dessert machines to flavor drinks, milkshakes, frozen desserts and other products. The syrups are mixed with ice and/or other ingredients or syrups and dispensed from the beverage machine. The syrups are typically provided in single-use bags that connect to the beverage machine. The use of large single-use bags results in a minimum quantity purchases from the syrup supplier by the user of the machine, adding costs particularly for low-volume users.

SUMMARY

In one embodiment, a beverage dispenser includes a mixing portion to mix a plurality of beverage ingredients and a dispensing portion to dispense the mixed beverage. The dispenser further includes a product input portion having a plurality of refillable ingredient bins operably connectible to the mixing portion. Each refillable ingredient bin includes a self-closing seal located at a bin outlet to prevent leakage of the beverage ingredients from the bin outlet when the refillable ingredient bin is disconnected from the mixing portion.

Alternatively or additionally, in this or other embodiments the seal is secured and/or locked to the ingredient bin via a removable seal holder.

Alternatively or additionally, in this or other embodiments the seal holder is securable to the ingredient bin via a twist-lock feature.

Alternatively or additionally, in this or other embodiments the seal is a silicone seal.

Alternatively or additionally, in this or other embodiments the ingredient bin has a sloping bottom to direct ingredients in the ingredient bin toward the bin outlet.

Alternatively or additionally, in this or other embodiments the ingredient bin includes a removable lid.

Alternatively or additionally, in this or other embodiments the plurality of ingredient bins are positioned in a cabinet.

In another embodiment, an ingredient bin assembly for a beverage dispensing machine includes a refillable ingredient bin having a bin outlet and a self-closing seal positioned at the bin outlet to prevent leakage of beverage ingredients from the bin outlet when the refillable ingredient bin is disconnected from a beverage dispensing machine.

Alternatively or additionally, in this or other embodiments the seal is secured and/or locked to the ingredient bin via a removable seal holder.

Alternatively or additionally, in this or other embodiments the seal holder is securable to the ingredient bin via a twist-lock feature.

Alternatively or additionally, in this or other embodiments the seal is retained at the seal holder between an inner seal holder and an outer seal holder.

Alternatively or additionally, in this or other embodiments the seal is a silicone seal.

Alternatively or additionally, in this or other embodiments the ingredient bin has a sloping bottom to direct ingredients in the ingredient bin toward the bin outlet.

Alternatively or additionally, in this or other embodiments the ingredient bin includes a removable lid.

These and other advantages and features will become more apparent from the following description taken in conjunction with the drawings.

DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

Figure 1:
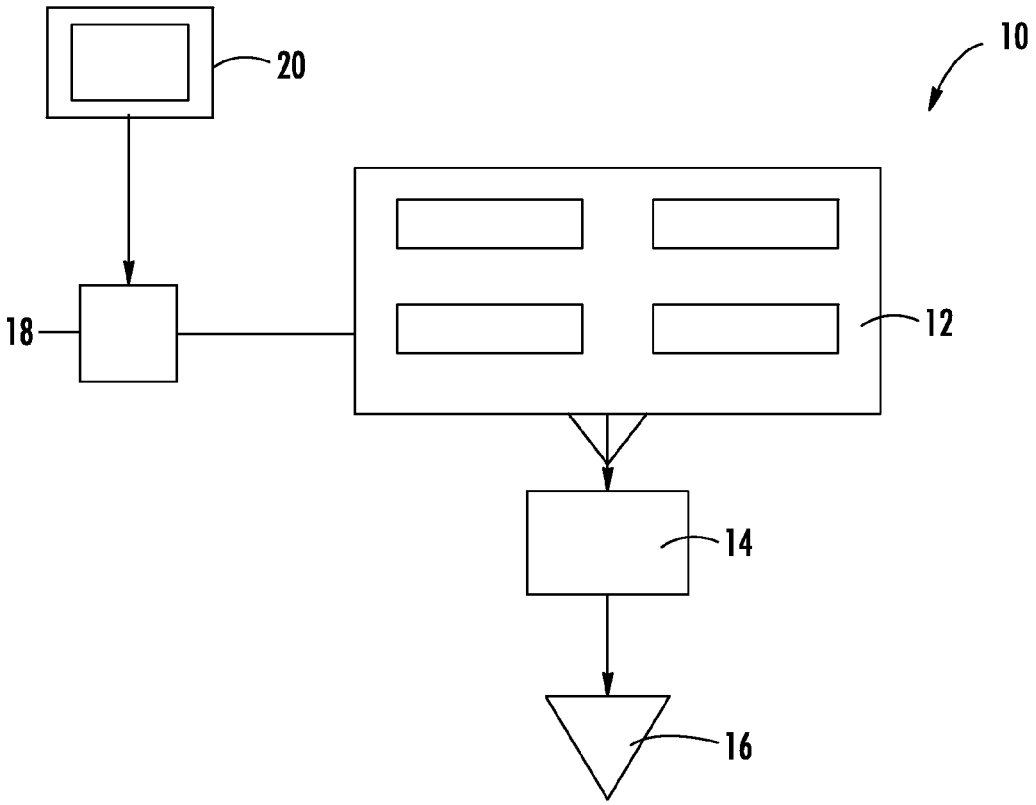
FIG. 1 is schematic illustration of an embodiment of a beverage machine.

The detailed description explains embodiments of the invention, together with advantages and features, by way of example with reference to the drawing.

DETAILED DESCRIPTION

Shown in FIG. 1 is a schematic view of an embodiment of a beverage machine 10. The beverage machine 10 includes a product input portion 12 a mixing portion 14 and a dispensing portion 16. Any number of ingredients, such as syrups, fruit, ice, ice creams, and the like are conveyed from the product input portion 12 into the mixing portion 14 where they are mixed, and then dispensed into a cup or other vessel at the dispensing portion 16. A controller 18 linked to, for example, an input panel 20, receives input from the input panel 20 specifying a selected beverage or product to be dispensed. The controller 18 follows a selected recipe to input ingredients from the product input portion 12 into the mixing portion 14 in required quantities and proportions.

Figure 2:
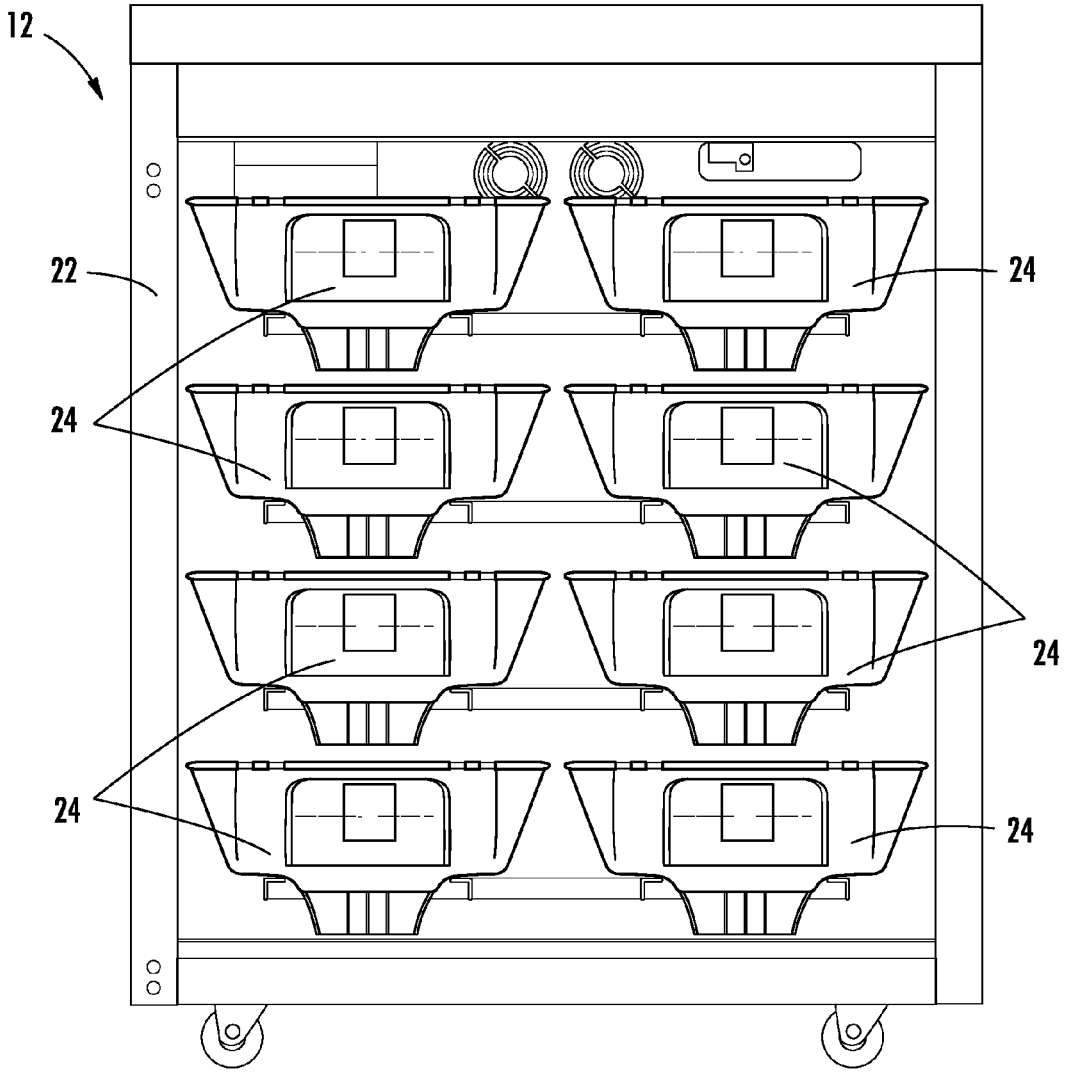
FIG. 2 is an illustration of an embodiment of a cabinet for a beverage machine.
Figure 3:
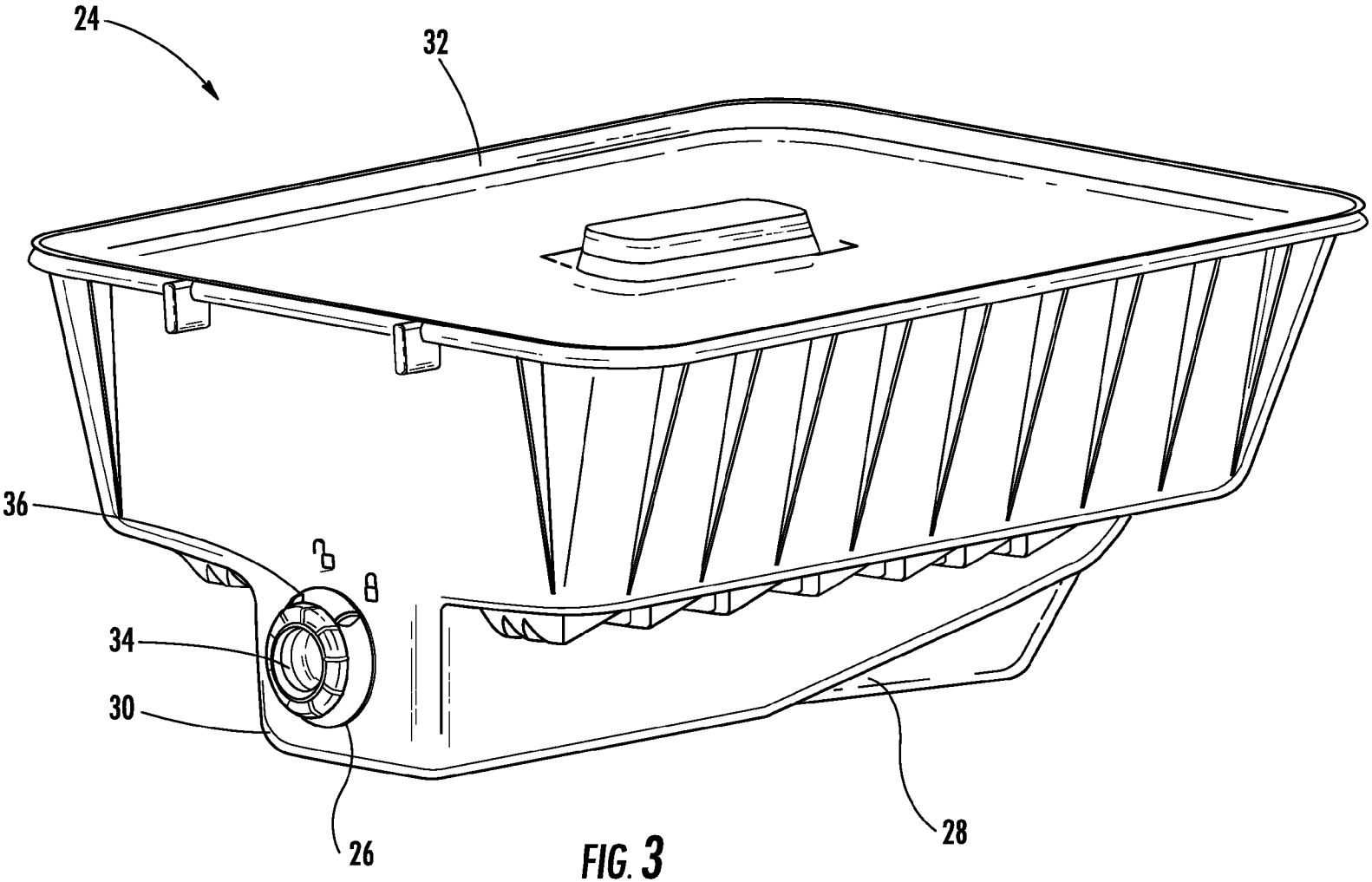
FIG. 3 is an illustration of an embodiment of an ingredient bin for a beverage machine.

Referring now to FIG. 2, in some embodiments, the product input portion 12 includes a cabinet 22 in which a number of ingredient bins 24 are positioned. Each bin 24 may hold a quantity of an ingredient such as a syrup or other flavoring, and are connected to the mixing portion 14, via a bin outlet 26, as shown in FIG. 3. The bin 24 includes a sloping bottom 28 to direct the syrup toward the bin outlet 26, located at a bin end 30. In some embodiments, the bin 24 further includes a lid 32 to prevent contamination of the syrup inside the bin 24. The bin outlet 26 allows for connection of the bin 24 to an output conduit (not shown) to convey the syrup to the mixing portion 14.

Figure 4:
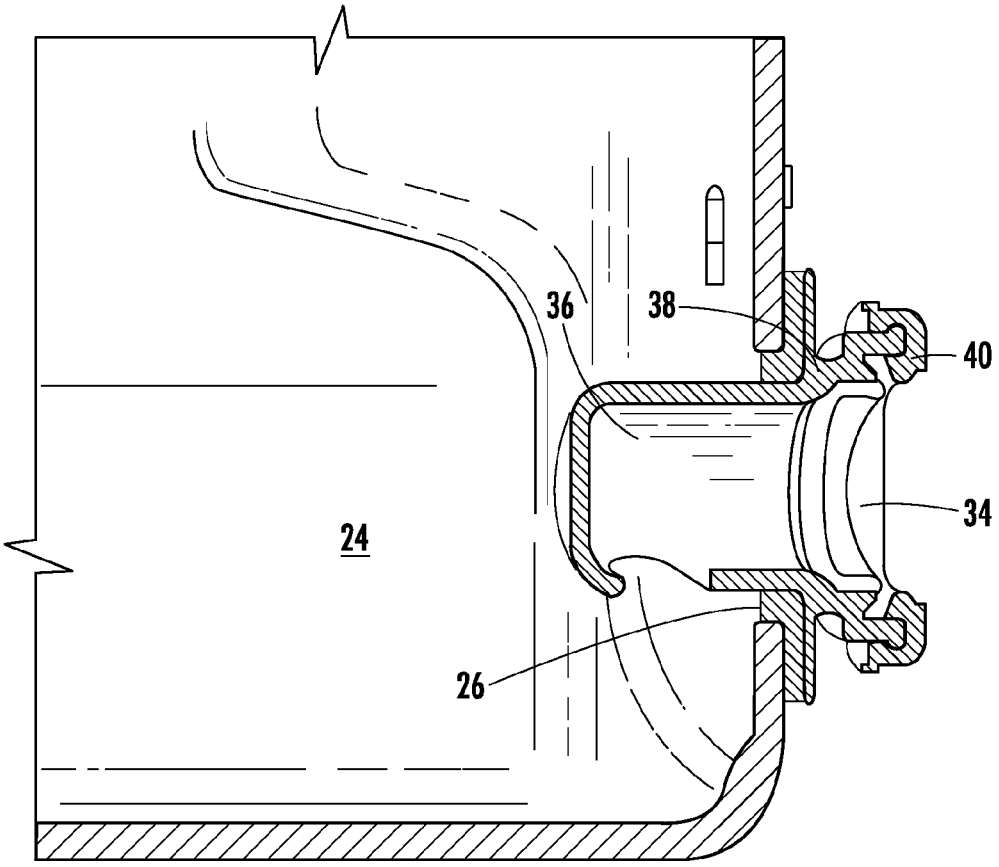
FIG. 4 is a cross-sectional view of an embodiment of a seal for an ingredient bin for a beverage machine.

Referring to FIG. 3, a seal 34 is disposed at the bin outlet 26 to seal around the output conduit when the bin is installed thereto and prevent leakage of the syrup out of the bin outlet 26 when the bin 24 is disconnected from the output conduit to, for example, clean or refill the bin 24. The seal 34 is a self-closing silicone seal held in place at the bin outlet 26 by a seal holder 36. In some embodiments, as shown in FIG. 4, the seal 34 is captured and retained between an inner seal holder 38 and an outer seal holder 40 of the seal holder 36.

Figure 5:
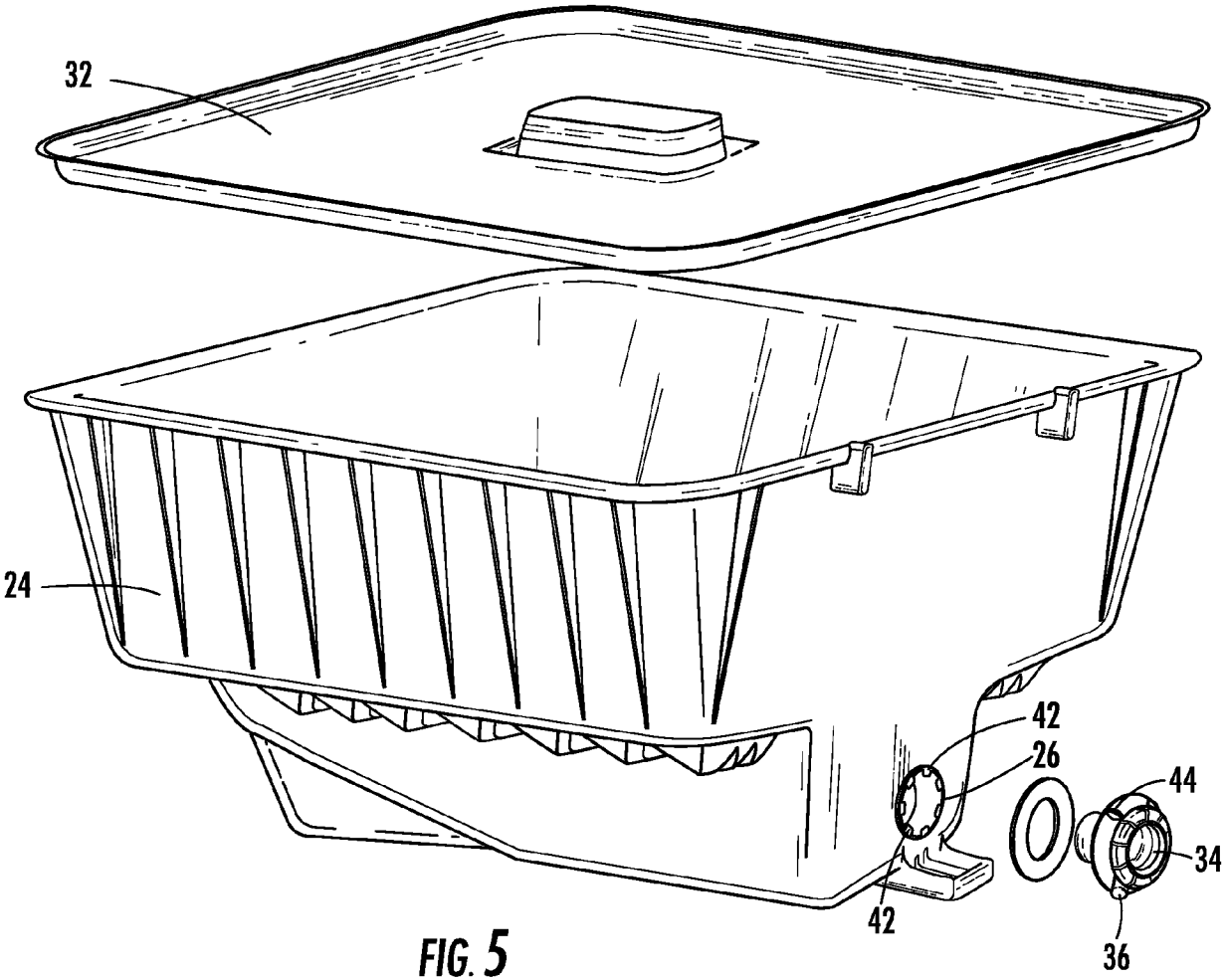
FIG. 5 is a partially exploded view of an embodiment of an ingredient bin.

The seal 34 and seal holder 36 are secured to the bin 24 at the bin outlet 26, and are removable from the bin 24 to allow for replacement of the seal 34 when desired, for example, when worn or damaged or at the end of the seal's useful life. In some embodiments, as shown in FIG. 5, the seal holder 36 is installed to the bin opening 26 and secured thereto via a twist-lock engagement. Such engagement is achieved via the use of notches 42 at the bin opening 26 and corresponding tabs 44 at the seal holder 36. To install the seal 34 and seal holder 36 to the bin opening 26, the tabs 44 are aligned with the notches 42 and the seal holder 36 is moved so that the not tabs 44 are at an interior of the bin 24. The seal holder 36 is then twisted, either clockwise or counterclockwise, to lock the seal holder 36 to the bin 24. The seal holder 36 is removed by reversing this sequence of operations. It is not be appreciated that while a twist-lock engagement is utilized in one embodiment, other locking schemes, for example, snaps, mechanical fasteners, or the like may be used.

Figure 6:
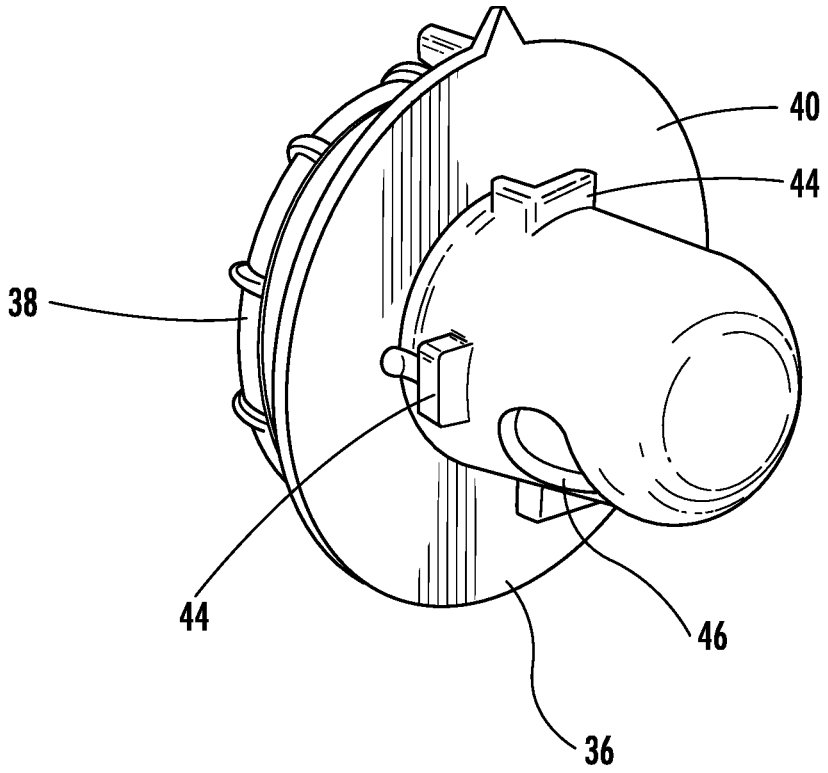
FIG. 6 is a perspective view of an embodiment of a seal assembly for an ingredient bin of a beverage machine.

Referring to FIG. 6, the seal holder 36 includes a holder inlet 46, which is an opening to direct syrup flow from the bin 24 toward the seal 34 and output conduit. The holder inlet 46 is oriented to increase bin 24 drainage and to decrease syrup remnants in the bin 24 before the bin 24 must be refilled. For example, in some embodiments the holder inlet 46 is directed slightly downwardly, as shown in FIG. 6.

The embodiments of the bin disclosed herein eliminate the need for a single-use bag, allowing syrup and other ingredients to be added directly to, and dispensed from the bin. By eliminating the bag, and the minimum volume ingredient purchase that accompanies it, the user of the machine is able to supply fresher ingredients, and also may utilize ingredients, such as fruits or flavored syrups, not available in single-use bag form.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A beverage dispenser comprising:

a mixing portion to mix a plurality of beverage ingredients;

a dispensing portion to dispense the mixed beverage; and a product input portion including a plurality of refillable ingredient bins operably connectible to the mixing portion via a bin outlet, each refillable ingredient bin including a self-closing seal disposed at the bin outlet to prevent leakage of the beverage ingredients from the bin outlet when the refillable ingredient bin is disconnected from the mixing portion;

the ingredient bin having a sloping bottom to direct ingredients in the ingredient bin toward the bin outlet;

the bin outlet disposed at a sidewall of the ingredient bin above the sloping bottom.

2. The beverage dispenser of claim 1, wherein the seal is secured to the ingredient bin via a removable seal holder.

3. The beverage dispenser of claim 2, wherein the seal holder is securable to the ingredient bin via a twist-lock feature.

4. The beverage dispenser of claim 1, wherein the seal is a silicone seal.

5. The beverage dispenser of claim 1, wherein the ingredient bin includes a removable lid.

6. The beverage dispenser of claim 1, wherein the plurality of ingredient bins are disposed in a cabinet.

7. An ingredient bin assembly for a beverage dispensing machine comprising:

a refillable ingredient bin having a bin outlet; and a self-closing seal disposed at the bin outlet to prevent leakage of beverage ingredients from the bin outlet when the refillable ingredient bin is disconnected from a beverage dispensing machine;

the ingredient bin having a sloping bottom to direct ingredients in the ingredient bin toward the bin outlet;

the bin outlet disposed at a sidewall of the ingredient bin above the sloping bottom.

8. The ingredient bin assembly of claim 7, wherein the seal is secured to the ingredient bin via a removable seal holder.

9. The ingredient bin assembly of claim 8, wherein the seal holder is securable to the ingredient bin via a twist-lock feature.

10. The ingredient bin assembly of claim 8, wherein the seal is retained at the seal holder between an inner seal holder and an outer seal holder.

11. The ingredient bin assembly of claim 7, wherein the seal is a silicone seal.

12. The ingredient bin assembly of claim 7, wherein the ingredient bin includes a removable lid.

* * * * *